US009743707B2

(12) United States Patent
Ballman

(10) Patent No.: US 9,743,707 B2
(45) Date of Patent: Aug. 29, 2017

(54) FOOTWEAR CLEAT PARTICULARLY FOR SOCCER

(71) Applicant: Jared C. Ballman, San Diego, CA (US)

(72) Inventor: Jared C. Ballman, San Diego, CA (US)

( * ) Notice: Subject to any disclaimer, the term of this patent is extended or adjusted under 35 U.S.C. 154(b) by 0 days.

(21) Appl. No.: 14/262,342

(22) Filed: Apr. 25, 2014

(65) Prior Publication Data

US 2014/0310994 A1 Oct. 23, 2014

Related U.S. Application Data

(63) Continuation-in-part of application No. 29/411,638, filed on Jan. 24, 2012, now Pat. No. Des. 715,526.

(51) Int. Cl.

| | |
|---|---|
| ***A43B 5/00*** | (2006.01) |
| ***A43B 13/22*** | (2006.01) |
| ***A43B 5/02*** | (2006.01) |
| ***A43C 15/16*** | (2006.01) |

(52) U.S. Cl.

CPC ..... *A43B 5/02* (2013.01); *A43C 15/16* (2013.01); *A43C 15/162* (2013.01)

(58) Field of Classification Search

CPC ..... A43C 15/16; A43C 15/161; A43C 15/162; A43B 5/001; A43B 5/02; A43B 13/22; A43B 13/26

USPC ..... D2/906, 908, 959; 36/67 R, 67 B, 67 A, 36/67 C, 67 D

See application file for complete search history.

(56) References Cited

U.S. PATENT DOCUMENTS

| | | | | |
|---|---|---|---|---|
| 3,577,663 | A * | 5/1971 | Mershon | 36/67 D |
| D295,231 | S | 4/1988 | Heyes | |
| D324,938 | S | 3/1992 | Cohen | |
| 5,201,126 | A * | 4/1993 | Tanel | 36/134 |
| D335,953 | S * | 6/1993 | Tyng | D2/954 |
| D355,754 | S * | 2/1995 | Brandon | D2/951 |
| D395,156 | S | 6/1998 | Adam | |
| D424,283 | S | 5/2000 | Snyder | |
| D431,894 | S * | 10/2000 | Begg et al. | D2/957 |
| 6,523,282 | B1 * | 2/2003 | Johnston | 36/133 |
| D490,596 | S * | 6/2004 | Belley | D2/956 |
| D551,431 | S | 9/2007 | Tomat | |
| D558,434 | S * | 1/2008 | Roth | D2/953 |
| 7,752,775 | B2 | 7/2010 | Lyden | |
| 7,802,379 | B2 | 9/2010 | Gerber | |
| D657,120 | S * | 4/2012 | Harper | D2/959 |
| D671,718 | S * | 12/2012 | McVicker | D2/908 |
| 2004/0055183 | A1 * | 3/2004 | Lee et al. | 36/128 |
| 2006/0042124 | A1 * | 3/2006 | Mills et al. | 36/59 C |

* cited by examiner

*Primary Examiner* — Khoa Huynh
*Assistant Examiner* — Katharine Gracz
(74) *Attorney, Agent, or Firm* — Timothy W. Fitzwilliam

(57) ABSTRACT

An innovated design for athletic footwear also known as a cleat is herein disclosed with soccer as the playing sport in mind. Primarily, it is the geometry and configuration of the individual cleats provided, as well as number of total cleat structures that engage a playing field, that are optimally designed to contact and transverse the field. In a preferred design, individual cleats are six-sided and therefore maximize a lateral surface area. An additional improved upper is also configured to the athletic footwear to provide increased power transfer to a ball in a kicking motion.

5 Claims, 6 Drawing Sheets

FOOTWEAR CLEAT PARTICULARLY FOR SOCCER

PRIORITY CLAIM

This patent application is a continuation-in-part and contains subject matter claiming benefit of the priority date of U.S. Des. Pat. App. Ser. No. 29/411,638 filed on Jan. 24, 2012 and entitled, "SPORTS SHOE SOLE BOTTOM WITH CLEATS"; accordingly, the entire contents of this design patent application is hereby expressly incorporated by reference.

BACKGROUND OF THE INVENTION

Field of the Invention

The present invention generally pertains to cleat footwear for soccer sports and the like. More specifically in a preferred embodiment, the invention relates to a unique cleat configuration designed optimally for specific movements on a grass playing field.

Description of the Prior Art

Shoes and a large majority of footwear generally comprise an upper (e.g. made from leather) coupled to a sole, for example from rubber or man-made material. A foot of a human can generally be sub-divided into a forward phalanx region and a mid-forward metatarsal region, an arch region and heel portion.

Athletic footwear comprising cleats configured to an outer sole have been known for ages for use on playing fields. However, improvements in design have been minimal and largely limited to the materials and manufacturing thereof, and not to the specific design and configuration of the product itself. One such design improvement was proposed by Auger, et al. and assigned to Nike Inc., and entitled "Article of Footwear Having a Regional Cleat Configuration," U.S. Pat. No. 7,007,410 and awarded patent protection in 2006.

According to Auger and his co-inventors, conventional cleats for soccer interfere with the flexibility and movement of the phalanges bones and metatarsal bones of a wear's foot. In other words, the typical cleat configurations of that time will provide traction but however interfere with the athlete's running sequence.

The present invention however approaches the issues of optimum design a bit differently. Instead, the optimum design will provide directional traction (i.e. cutting), while further providing start/stop capability (i.e. first get-off step, acceleration and deceleration). Also, the present invention seeks to perform these functions with reduced drag as to not interfere with the athlete's running sequence, top speed and side to side kicking movements through playing surface comprising natural grass.

Another more recent example is provided by Baker et al. also assigned to Nike Inc., entitled "Cleat Assembly," U.S. Pat. No. 8,365,442 and awarded patent protection in 2013. According to Baker and his co-inventors, the grip of a cleat coupled to a playing surface also provides resistance for a wearer to propel himself or herself in a desired direction. Further, cleats of exert a force against the playing surface that provides a resistance to allow the wearer to move in the desired direction without stopping. Accordingly, a wearer may move in a lateral and/or longitudinal direction by pushing against the force of the cleat's grip with the playing surface.

Baker continues that they believe there remains a need in the art for cleat design that provides traction, while still allowing the wearer to move in a desired direction while also providing a level of stability. The present invention has similar virtuous goals, however, approached differently. To date no other design has effectively sought to increase a surface area on a side of a cleat while minimizing a total volume thereof. Additionally, the Baker solution seems inappropriate for soccer, because soccer cleats should be rotationally aligned for movement in a multitude of direction, which Baker apparently is not.

In light of the above design objectives, the present invention aims to provide an optimum cleat geometry, as well as advanced design for specific regions of the foot such as the phalanx and metatarsal regions having an instep and an outer step, in addition to a heel region. The present invention further provides a cleat designed by an athlete with an athlete in mind having an improved upper portion limited to covering approximately the first two toes and the instep portion covering the phalanx and metatarsal regions of the big toe. The improved cleat further has an upper for the purpose of adding power in kicking a soccer ball. It is yet further an additional object of the present invention to provide a design having a plurality of cleats with subsystems that are equally spaced.

BRIEF SUMMARY OF THE INVENTION

The present invention specifically addresses and alleviates the above mentioned deficiencies associated with the prior art. More particularly, the present invention in a first aspect, is an article of cleated footwear, particularly for soccer, football, golf and similar sports comprising: an upper for covering an athlete's foot; a sole attached to the upper around a periphery thereof; and four groups of ground engaging members, the first group at an instep phalanx region, the second group at an outstep phalanx region, the third group at a metatarsal region and a fourth group at a heel region.

The article of cleated footwear herein, particularly for soccer, football, golf and similar sports is additionally characterized wherein the first group comprises a ground engaging member adjacent to a second group, the second group comprising a ground engaging member adjacent to the first group, wherein said adjacent ground engaging members are offset by 90 degrees.

Still further, the cleat herein is more specifically set forth wherein third group comprises: a first ground engaging member at a 12 o'clock position; a second ground engaging member at a 3 o'clock position; a third ground engaging member at a 6 o'clock position; and a fourth ground engaging member at a 9 o'clock position.

In yet another aspect, the invention is characterized as an article of cleated footwear, particularly for a soccer sport and similar sports, and further particularly designed for a grass playing field comprising: an upper for covering an athlete's foot; a sole attached to the upper around a periphery thereof; and a plurality of ground engaging members connected to the sole and extending downwardly therefrom, each of the plurality of ground engaging members having a footprint (together with its height which is fixed for the purpose of this invention) defining a lateral surface area, further each of the plurality of ground engaging members also having a rotational orientation, wherein one of the plurality of ground engaging members has a footprint having a larger apex triangle configured next to a smaller apex triangle, wherein the larger apex triangle shares a base with the smaller apex triangle thereby forming a six sided footprint to the ground engaging member, also thereby provided a relatively large lateral surface area due to the six sided footprint relative to a volume of the ground engaging member.

The invention in this aspect is additionally characterized wherein the one of the plurality of ground engaging members is rotated so that the large apex triangle faces straight down with respect to a toe of the article of footwear, the one of the plurality of ground engaging members thereby being rotated to the 6 o'clock position (footprint comprising a triangle having an apex aligned to the negative y-axis).

The article of cleated footwear, particularly for the soccer sport and similar sports of claim 4, the first group being positioned approximately at an outstep region of the sole, wherein the group comprises four ground engaging members, wherein a first of the first group is in the 3 o'clock position and wherein a second, a third and a fourth ground engaging members are rotated and positioned between the 1 o'clock and the 3 o'clock positions.

Yet further, the invention in this aspect is characterized as comprising: a second group of ground engaging members the second group at an instep and in a phalanx region of the sole, the second group comprising three ground engaging members that are equally spaced; and a third group of ground engaging members the third group approximately at a metatarsal region, the metatarsal region between the phalanx region and a heel region, the third group comprising three ground engaging members approximately evenly spaced, wherein a first and a second of the third group of ground engaging members is approximately in a 6 o'clock position and a third ground engaging member is in a 9 o'clock position.

The cleat in this second aspect is additionally characterized wherein the plurality of ground engaging members being separated into four groups and three regions, the four groups comprising a first group, a second group, a third group and a fourth group, wherein further the three regions comprising a phalanx region, a metatarsal region, and a heel region, wherein the first group overlaps the phalanx region and the metatarsal region.

Yet still further, the cleated footwear, particularly for the soccer sport and similar sports, is characterized wherein the plurality of ground engaging members comprising fourteen ground engaging members, the fourteen members being optimally chosen to provide a maximum lateral surface area to the ground engaging member while minimizing a total volume of the fourteen ground engaging members. Also the upper has a reinforced portion, the reinforced portion comprising: a first three sided reinforced area, the first three-sided reinforced area at an instep phalanx region; and a second three sided reinforced area, the second three-sided reinforced area approximately at a transition between the instep phalanx region and the metatarsal region.

In a third aspect, the invention is a cleat comprising: an upper for covering an athlete's foot; a sole attached to the upper around a periphery thereof; a first group of ground engaging members at an outstep of the sole, the first group having portions covering a phalanx region and a metatarsal region of the sole, the first group of ground engaging members further being equally spaced; a second group of ground engaging members at an instep phalanx region of the sole, the second group having portions covering a phalanx region and a metatarsal region of the sole, the first group of ground engaging members further being equally spaced; and a third group of ground engaging members at a metatarsal region of the sole, the third group of ground engaging members further being equally spaced, wherein each of the ground engaging member are connected to the sole and extending downwardly there from.

These, as well as other advantages of the present invention will be more apparent from the following description and drawings. It is understood that changes in the specific structure shown and described may be made within the scope of the claims, without departing from the spirit of the invention.

While the apparatus and method has or will be described for the sake of grammatical fluidity with functional explanations, it is to be expressly understood that the claims, unless expressly formulated under 35 USC 112, are not to be construed as necessarily limited in any way by the construction of "means" or "steps" limitations, but are to be accorded the full scope of the meaning and equivalents of the definition provided by the claims under the judicial doctrine of equivalents, and in the case where the claims are expressly formulated under 35 USC 112 are to be accorded full statutory equivalents under 35 USC 112. The invention can be better visualized by turning now to the following drawings wherein like elements are referenced by like numerals.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION OF PREFERRED EMBODIMENTS

Figure 1:
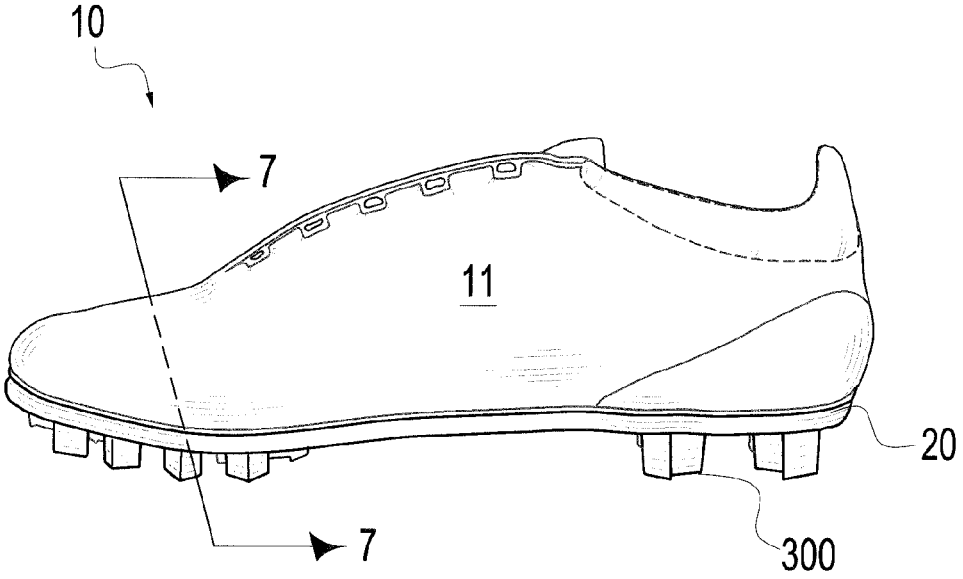
FIG. 1 is a profile view of a first preferred athletic cleat embodiment of the present invention.
Figure 2:
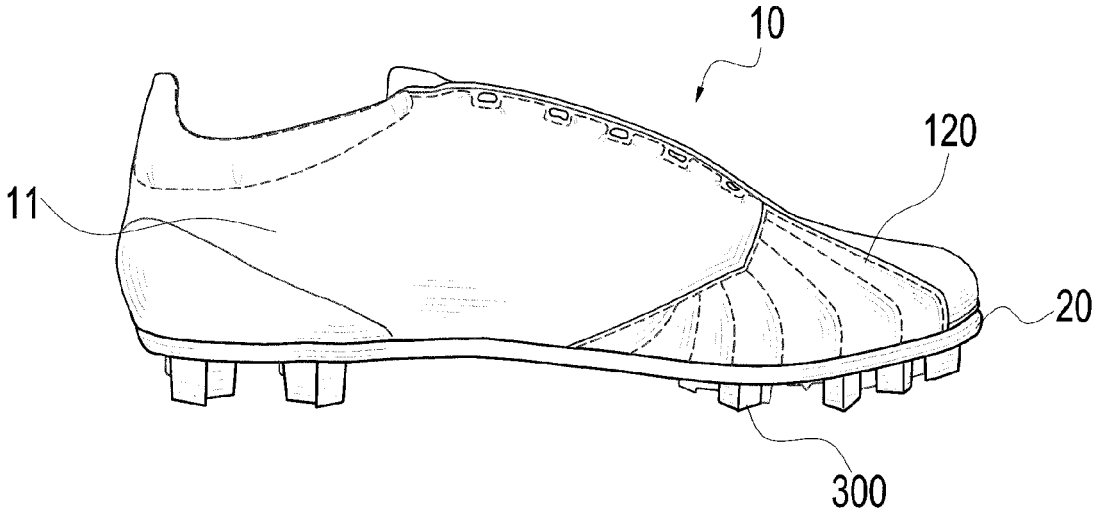
FIG. 2 illustrates an additional profile view from an opposite side with respect to FIG. 1.

Regarding FIG. 1 and FIG. 2, profile views of an article of cleated footwear 10, particularly for a soccer sport and similar sports, and further particularly designed for a grass playing field are illustrated. It should be noted, that the cleat could further ideally be designed for artificial surface, particularly by adjusting cleat height, however, the cleat height is not the main focus of the invention.

Generally, the athletic shoe 10 is an upper 11, for covering an athlete's foot, attached to a sole 20 with the sole having a plurality of ground engaging members 300 connected to said sole and extending downwardly therefrom. Importantly, the upper 11 comprises a reinforced portion 120 having an extra layer of material configured over the upper 11 approximately at an instep phalanx area, as further described herein.

Figure 3A:
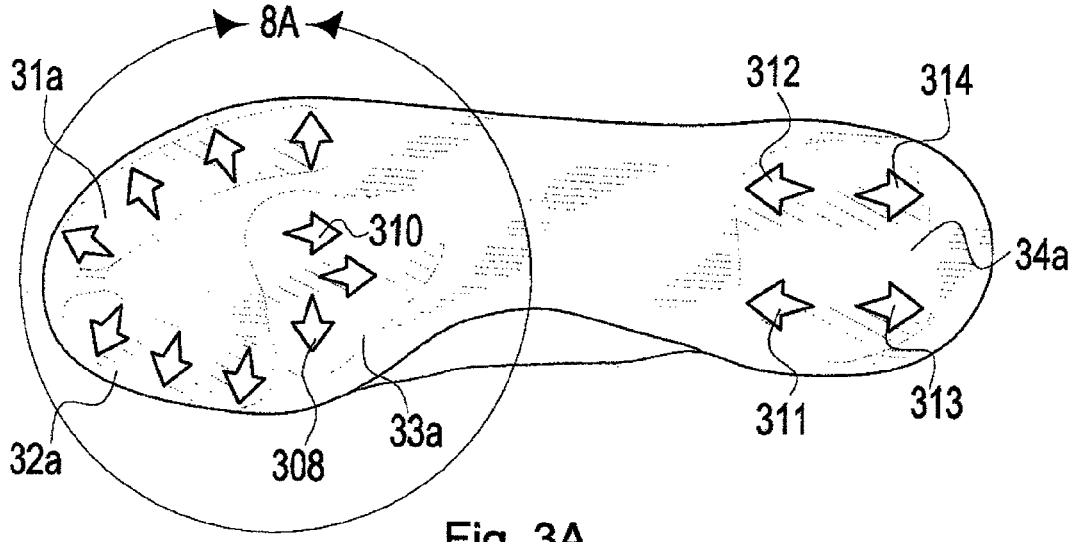
FIG. 3A is an underside of a sole of the present invention showing individual ground engaging member footprints, their grouping, and rotation.

With reference to FIG. 3A, an underside of the sole of the present invention showing individual ground engaging member (cleats) footprints 301, 302, 303, 304, 305, 306, 307, 308, 309, 310, 311, 312, 313, 314, their grouping, geometry and rotation, is illustrated. Since a height of each cleat is either fixed or predetermined, the present invention seeks to optimize geometry, alignment (rotation) and grouping 31*a*, 32*a*, 33*a*, 34*a* of cleats for different directional movements of a soccer player while further taking into account traction and drag properties as provided by a particular soccer cleat 10 design. For example, a cutting motion laterally and similarly a lateral kicking motion are contemplated herein as movements that require optimum geometry.

Continuing with regard to FIG. 3A, the cleat arrangement comprises four distinct groups (or sub-systems) 31*a*, 32*a*, 33*a*, 34*a*, that are designed for optimum lateral motion, cutting or striking laterally, acceleration, deceleration and top line speed. Notably, each of the cleats 301, 302, 303, 304, within the first group 31*a*, are equally spaced with respect to the others but not with respect to the other groups, 32*a*, 33*a*, 34*a*. The same holds true for the second 32*a* and third groups 33*a* and cleats 305, 306, 307, 308, 309, 310; as well as the fourth group 34*a* and individual cleats 311, 312, 313, 314.

Figure 3B:
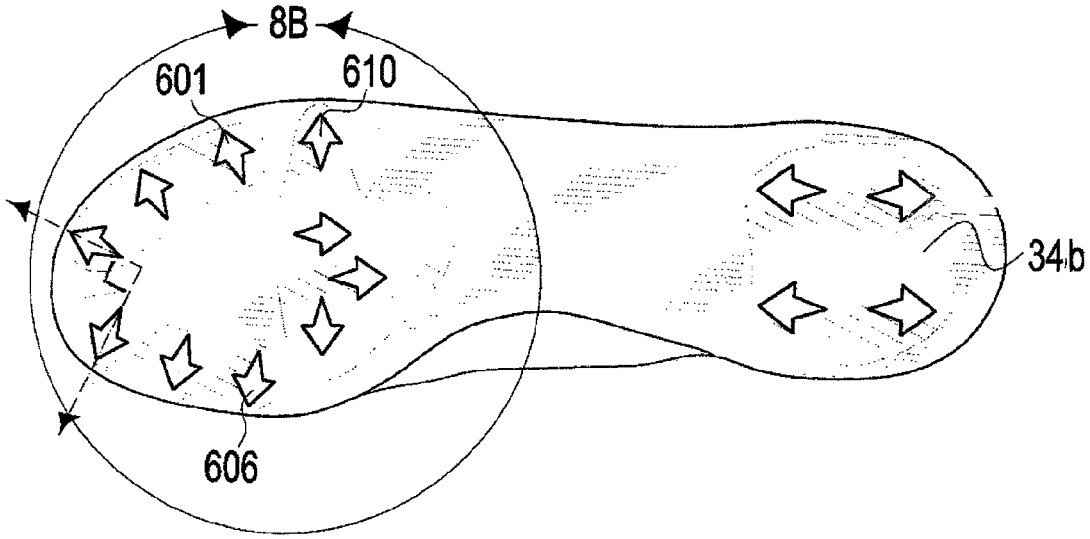
FIG. 3B illustrates an alternative configuration as compared to FIG. 3A.

Continuing with regard to FIG. 3B, a second cleat arrangement comprises four distinct groups (or sub-systems) 31*b*, 32*b*, 33*b*, 34*b*, that are designed for optimum lateral motion, cutting or striking laterally, acceleration, deceleration and top line speed. Notably, each of the cleats 601, 602, 603, within the first group 31*b*, are equally spaced with respect to the others but not with respect to the other groups, 32*b*, 33*b*, 34*b*. The same holds true for the second 32*b* and third groups 33*b* and cleats 604, 605, 606, 607, 608, 609, 610 as well as the fourth group and individual cleats. Further and also with regard to FIG. 8B, first group 31*b* cleat 603 adjacent to second group 32*b* cleat 604 are offset by a 90 degree angle; further wherein all of first 31*b* and second 32*b* groups have a tangential relationship to the outer edge of the sole 11.

Additionally with regard to FIG. 3A (and FIG. 3B), the geometrical footprint of each of the cleats 300 is optimally chosen to increase lateral surface area while limiting total volume. In other words, by providing a six sided structure as compared to a three or four sided structure, the lateral surface area is increased given a fixed volume of a cleat. Further design characteristics for cleat 300 geometry and rotation are provided herein.

Figure 4:
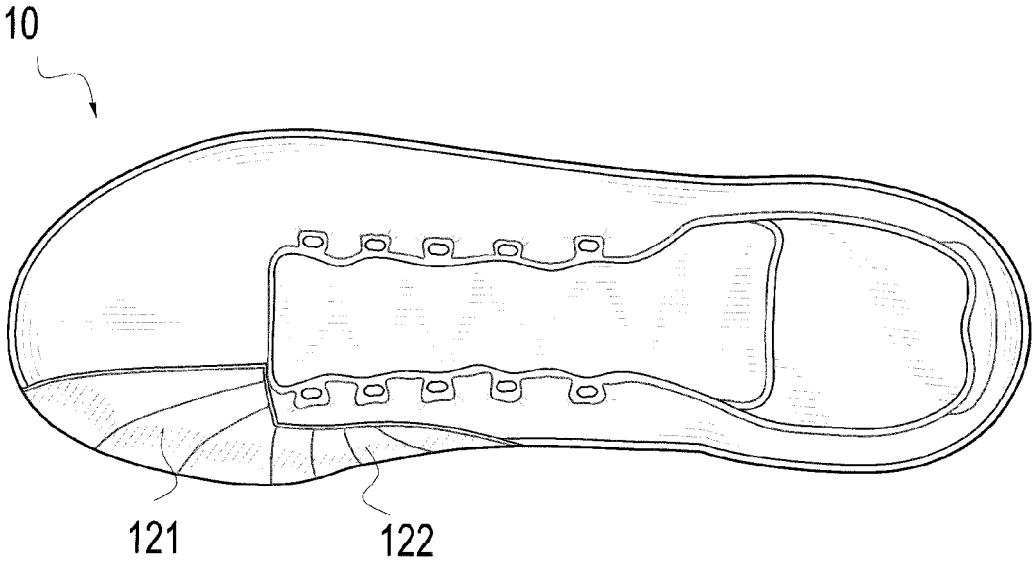
FIG. 4 is a top plan view of the first preferred embodiment, however illustrating a left shoe and not a right shoe as in the previous figures.
Figure 5:
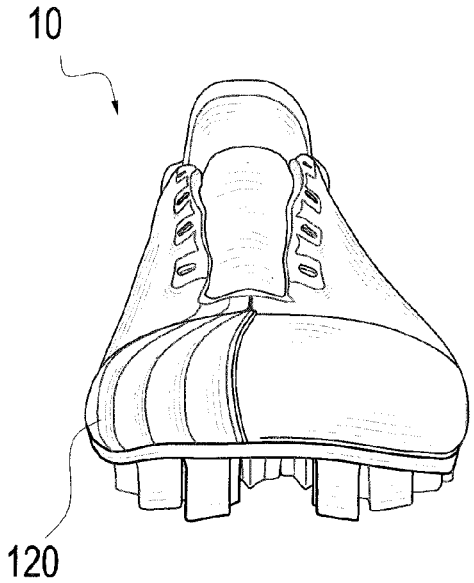
FIG. 5 is a front view of the right cleat.
Figure 6:
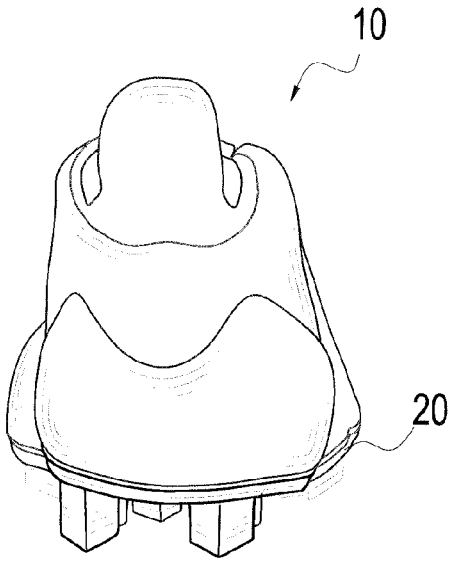
FIG. 6 is a rear view thereof.

FIG. 4 and FIG. 5 illustrate top and front views of the soccer cleat 10 of the present invention also showing a reinforced portion particularly for adding power in a striking motion. As noted, the plurality of ground engaging members 300 have a fixed height, and/or a predetermined height that may depend on grass length or generally playing surface condition/weather or other factors not applicable to the present invention.

Figure 7:
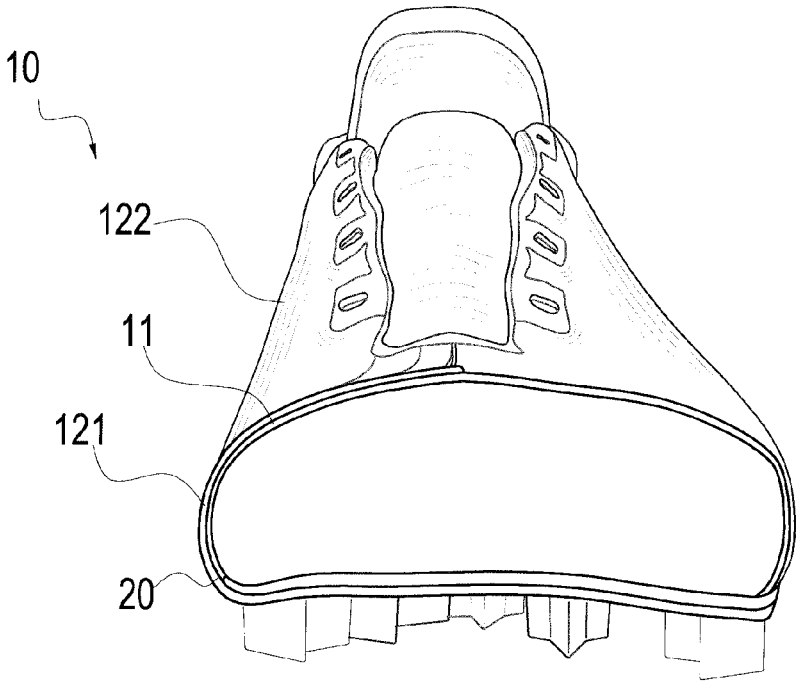
FIG. 7 is a cross section view illustrating a reinforced instep upper.

Further with reference to FIG. 4 and FIG. 5, the top plan view of an upper of the present invention embodiment 10 is illustrated. As shown, the reinforced area 120 (also as illustrated in FIG. 7) has extra material supporting an instep area. More specifically a first three sided reinforced area 121 is provided at an instep phalanx region. A second three sided reinforced area 122 is provided adjacent to the first. As shown each of the reinforced areas 121, 122 are triangle shaped, or more specifically pie-wedge shaped. Further, the second three-sided reinforced area 122 covers approximately at a transition between the instep phalanx region and the metatarsal region of a wear's foot.

Figure 8A:
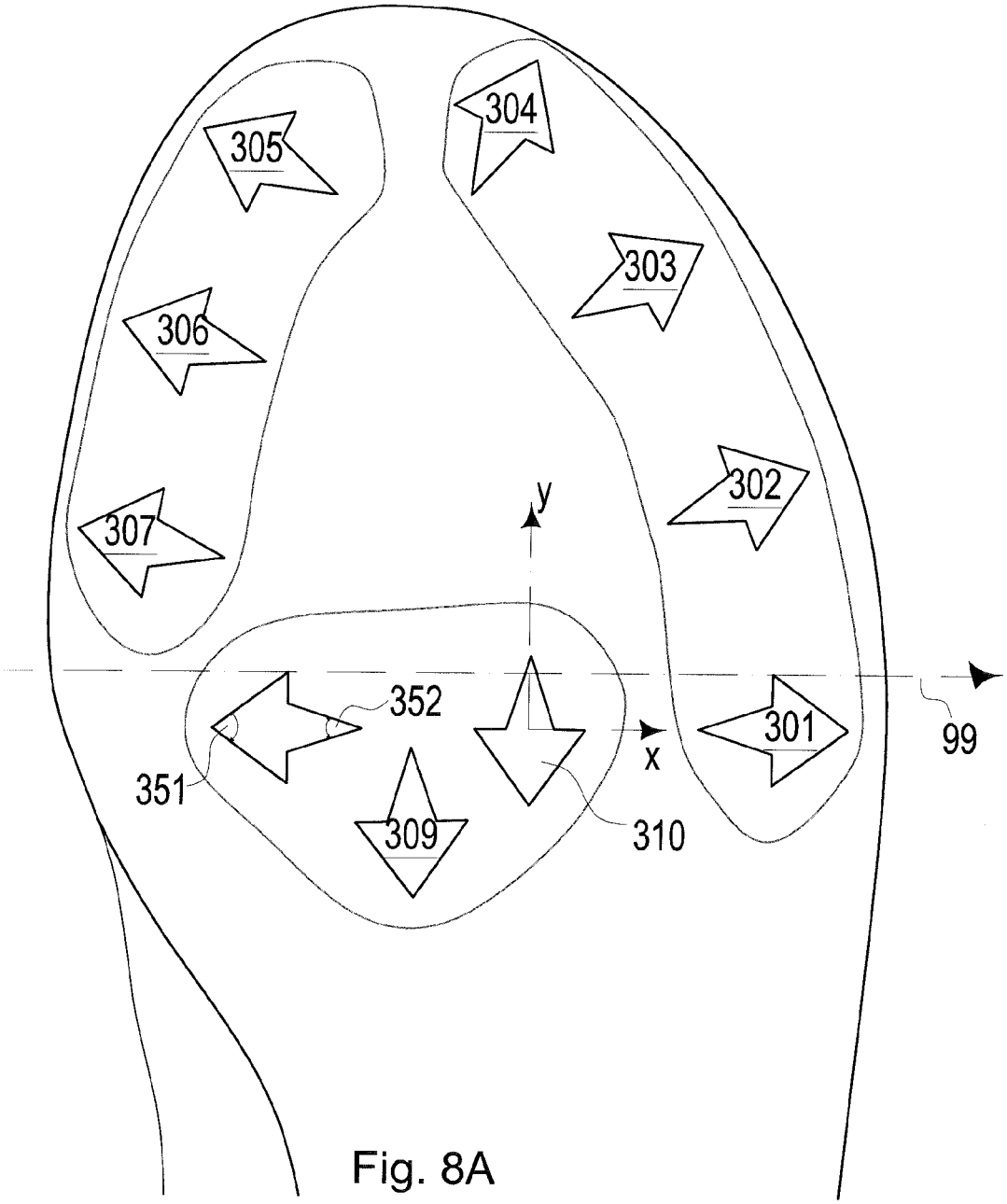
FIG. 8A is a first enlarged view of the area circumscribed by line 8A in FIG. 3A.
Figure 8B:
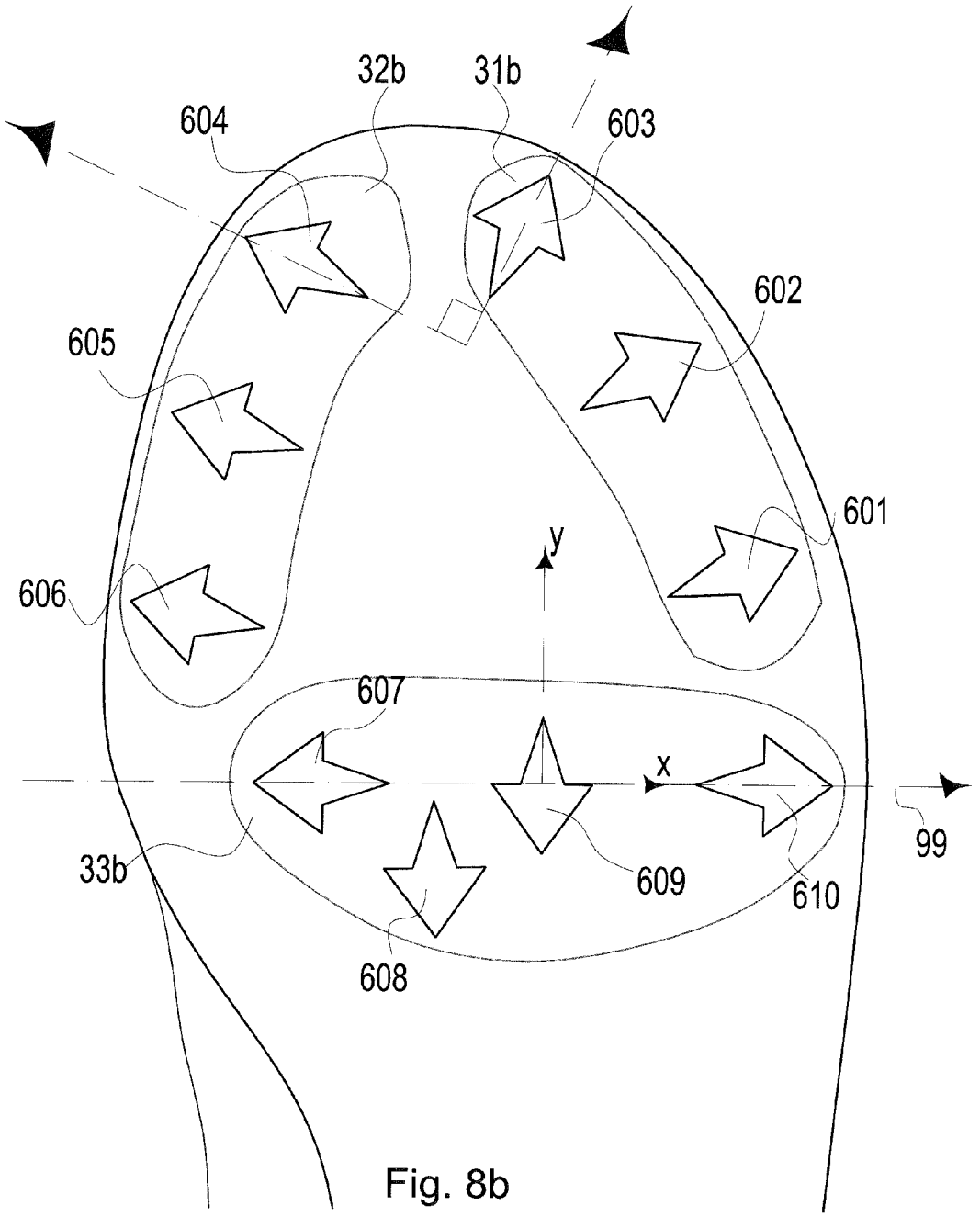
FIG. 8B is a second enlarged view the area circumscribed by line 8B in FIG. 3B.

FIG. 8A illustrates an enlarged view of the areas circumscribed by line 8A-8A in FIG. 3A. In a first aspect, each of the plurality of ground engaging members 300 have an optimum geometry in a footprint aspect. More specifically, it's a six sided structure 300 comprising a larger apex 351 triangle configured next to a smaller apex triangle 352 wherein both triangles share base portions opposite to their apexes 351, 352. As stated, this provides a relatively large lateral surface area due to the six sided footprint relative to a volume of the ground engaging member.

The individual ground engaging members 301, 302, 303, 304, 305, 306, 307, 308, 309, 310, 311, 312, 313, 314 are also defined by also having a rotational orientation. The rotational orientation is defined by the large apex triangle facing upward toward a toe of the show (as in the y-axis of FIG. 8). Also, line 99 is used to define phalanx and metatarsal regions of the sole and a wear's foot wherein above line 99 defines the phalanx region and below line 99 defines the metatarsal region.

Many alterations and modifications may be made by those having ordinary skill in the art without departing from the spirit and scope of the invention. Therefore, it must be understood that the illustrated embodiments have been set forth only for the purposes of example and that it should not be taken as limiting the invention as defined by the following claims. For example, notwithstanding the fact that the elements of a claim are set forth below in a certain combination, it must be expressly understood that the invention includes other combinations of fewer, more or different elements, which are disclosed in above even when not initially claimed in such combinations.

While the particular Footwear Cleat Particularly for Soccer as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

What is claimed is:

1. An article of cleated footwear, particularly for soccer, football, golf and similar sports comprising:

an upper for covering an athlete's foot;

a sole attached to the upper around a periphery thereof; and four groups of ground engaging members, each of the ground engaging members having a footprint defining a lateral surface area, each of ground engaging members also having a rotational orientation, wherein the plurality of ground engaging members has a footprint having a larger apex triangle next to a smaller apex triangle, wherein the larger apex triangle shares a base with the smaller apex triangle, thereby forming a six sided footprint to the ground engaging member, wherein each of a footprint six sides are outwardly facing with respect to a center of the footprint six sides, also thereby providing a relatively large lateral surface area due to the six sided footprint relative to a volume of the ground engaging member, the footprint further being a bottom most horizontal plane of an individual cleat adapted to contact the ground;

the first group at an instep phalanx region of the footwear, the second group at an outstep phalanx region of the footwear, the third group at a metatarsal region and the fourth group at a heel region of the footwear, and wherein the third group comprises:

a first ground engaging member at a 12 o'clock position with respect to a toe of the footwear, further wherein the 12 o'clock position corresponds to a point of the first ground engaging member at a zero degree offset with respect to the toe, further wherein the 12 o'clock position and the point of the first ground engaging member at the zero degree offset with respect to the toe corresponds to a y-axis of an x-y axis, said point of the first ground engaging member further being the smaller apex of the first ground engaging member corresponding to the 12 o'clock position, while directly opposite the point of the first ground engaging member, along the y-axis, is the larger apex of the first ground engaging member a second ground engaging member at a 3 o'clock position with respect to the toe of the footwear, further wherein the 3 o'clock position corresponds to a point of the second ground engaging member at a 90 degree offset with respect to the toe, further wherein the 3 o'clock position and the point of the second ground engaging member at a 90 degree offset with respect to the toe corresponds to a x-axis of an x-y axis; said point of the second ground engaging member being the larger apex of the second ground engaging member corresponding to the 3 o'clock position, while directly opposite the point of the second ground engaging member, along the x-axis, is the smaller apex of the second ground engaging member, a third ground engaging member at a 6 o'clock position with respect to the toe of the footwear, further wherein the 6 o'clock position corresponds to a point of the third ground engaging member at a 180 degree offset with respect to the y-axis; said point of the third ground engaging member being the larger apex of the third ground engaging member corresponding to the 6 o'clock position; while directly opposite the point of the third ground engaging member, along the y-axis, is the smaller apex of the third ground engaging member; and a fourth ground engaging member at a 9 o'clock position with respect to the toe of the footwear, further wherein the 9 o'clock position corresponds to a point of the fourth ground engaging member at a 270 degree offset with respect to the y-axis, said point of the fourth ground engaging member being the large apex of the fourth ground engaging member corresponding to the 6 o'clock position, while directly opposite the point of the fourth ground engaging member, along the x-axis, is the smaller apex of the fourth ground engaging member; wherein the rotational orientation of each ground engaging member is selected to effectively cut through a grass playing surface.

2. The article of cleated footwear, particularly for soccer, football, golf and similar sports of claim 1, wherein the first group comprises a ground engaging member adjacent to a second group, the second group comprising a ground engaging member adjacent and directly next to and closest to the first group, wherein said adjacent and directly next to and closest to ground engaging members are offset by 90 degrees.

3. The article of cleated footwear, particularly for the soccer sport and similar sports of claim 1, further comprising:

the first group comprising three ground engaging members that are equally spaced.

4. The article of cleated footwear, particularly for the soccer sport and similar sports of claim 1, the ground engaging members comprising fourteen ground engaging members, the fourteen members being optimally chosen to provide a maximum lateral surface area to the ground engaging member while minimizing a total volume of the fourteen ground engaging members.

5. The article of cleated footwear, particularly for the soccer sport and similar sports of claim 1, wherein the upper comprises a reinforced portion, the reinforced portion comprising:

a first three sided reinforced area on the surface of the upper, the first three-sided reinforced area at an instep phalanx region of the sole; and a second three sided reinforced area on the surface of the upper, the second three-sided reinforced area approximately at a transition between the instep phalanx region and a metatarsal region of the sole.

* * * * *